United States Patent [19]

Repp et al.

[11] Patent Number: 4,487,506

[45] Date of Patent: Dec. 11, 1984

[54] REVERSING ROLL INVERTER WITH BYPASS CAPABILITY

[75] Inventors: Thomas J. Repp, Penfield; Robert P. Rebres, Fairport, both of N.Y.

[73] Assignee: Xerox Corporation, Stamford, Conn.

[21] Appl. No.: 410,202

[22] Filed: Aug. 23, 1982

[51] Int. Cl.[3] ..... B65H 1/24; B65H 29/60; G03B 27/32; G03B 27/62

[52] U.S. Cl. ..... 355/14 SH; 355/3 SH; 355/3 R; 355/14 R; 355/24; 271/3.1; 271/4; 271/145; 271/166

[58] Field of Search ..... 355/14 C, 14 R, 24, 355/26, 48, 14 SH, 50, 3 R, 3 SH, 8, 11, 51, 66; 377/8, 30, 39; 430/31; 271/3.1, 145, 166, 9, 65, 4, DIG. 9, 186; 255/3 R

[56] References Cited

U.S. PATENT DOCUMENTS

| | | | |
|---|---|---|---|
| 3,416,791 | 12/1968 | Beckman, Jr. et al. | 271/65 |
| 3,588,472 | 6/1971 | Glaster et al. | 355/14 R X |
| 3,940,210 | 2/1976 | Donohue | 355/24 X |
| 3,942,785 | 3/1976 | Stange | 271/65 |
| 3,944,212 | 3/1976 | Stange et al. | 271/9 |
| 3,963,345 | 6/1976 | Stemmle et al. | 355/50 |
| 4,008,958 | 2/1977 | Kingsland | 355/51 |
| 4,050,816 | 9/1977 | Stemmle | 355/50 X |
| 4,080,063 | 3/1978 | Stemmle | 355/50 |
| 4,166,558 | 9/1978 | Adamek et al. | 355/24 |
| 4,210,319 | 7/1980 | Hynes | 271/166 X |

*Primary Examiner*—John F. Gonzales
*Assistant Examiner*—Terry Flower
*Attorney, Agent, or Firm*—William A. Henry, II

[57] ABSTRACT

A dual purpose tri-roll inverter is disclosed as part of the normal paper path of a copier and has the capability of taking a sheet into the input side of tri-roll input/output members and continue feeding the sheet by the use of reversible rolls through an out of a channel portion of the inverter for further processing. Alternatively, when reversing of the sheet is required for duplexing, the reversible rolls are reversed by a reverse drive mechanism to propel the sheet while it is still in the inverter back toward the output side of the tri-rolls.

8 Claims, 7 Drawing Figures

REVERSING ROLL INVERTER WITH BYPASS CAPABILITY

BACKGROUND OF THE INVENTION

The present invention relates to an improved sheet inverting system, and more particularly to an inverter adapted to be placed within the normal paper path of a copier while providing improved handling of variable sized sheets as well as curled sheets within the inverter.

As xerographic and other copiers increase in speed, and become more automatic, it is increasingly important to provide higher speed yet more economical, reliable and more automatic handling of both the copy sheets being made by the copier and the original document sheets being copied. It is desired to accommodate sheets which may vary widely in size, weight, thickness, material, condition, humidity, age, etc. These variations change the beam strength or flexural resistance and other characteristics of the sheets. Yet, the desire for automatic and high speed handling of such sheets without jams, misfeeds, uneven feeding times, or other interruptions increases the need for reliability of all sheet handling components. A sheet inverter is one such sheet handling component with particular reliability problems.

Although a sheet inverter is referred to in the copier art as an "inverter", its function is not necessary to immediately turn the sheet over (i.e., exchange one face for the other). Its function is to effectively reverse the sheet orientation in its direction of motion. That is, to reverse the lead edge and trail edge orientation of the sheet. Typically in inverter devices, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

Inverters are particularly useful in various systems of pre or post collation copying, for inverting the original documents, or for maintaining proper collation of the sheets. The facial orientation of the copy sheet determines whether it may be stacked in forward or reversed serial order to maintain collation. Generally, the inverter is associated with a by-pass sheet path and gate so that a sheet may selectively by-pass the inverter, to provide a choice of inversion or non-inversion.

Typically in a reversing chute type inverter, the sheet is fed in and then wholly or partially released from a positive feeding grip or nip into the inverter chute, and then reacquired by a different feeding nip to exit the inverter chute. Such a temporary loss of positive gripping of the sheet by any feed mechanism during the inversion increases the reliability problems of such inverters.

As noted above, many inverters, particularly those utilizing only gravity, have reliability problems in the positive output or return of the sheet at a consistent time after the sheet is released in the inverter chute. Those inverters which use chute drive rollers or other drive mechanisms of the type disclosed in U.S. Pat. No. 3,416,791, have a more positive return movement of the sheet, but this normally requires a movement actuator (clutch or solenoid) for the drive and either a sensor or a timing mechanism to determine the proper time to initiate the actuation of this drive mechanism so that it does not interfere with the input movement of the sheet, and only thereafter acts on the sheet to return it to the exit nip or other feed-out areas. Further, inverter reliability problems are aggravated by variations in the condition or size of the sheet. For example, a pre-set curl in the sheet can cause the sheet to assume an undesirable configuration within the chute when it is released therein, and interfere with feed-out.

The present invention is directed to improving the reliability of the inverter in this and other critical aspects of this operation, yet to also serve as a part of the sheet transport and accommodate a range of different sheet sizes within the same size inverter and the same mechanism. The present invention provides these improvements with an extremely low cost and simple tri-roll inverter apparatus located in the normal paper path of a copier and includes constantly rotating reversible rolls located downstream of the sheet input and output drives that either forwards or reverses sheets as required.

The advantages of the present invention over prior inverters are numerous, for example, due to the location of the reversible rolls in relatively close proximity to the tri-rolls this device maintains positive control of copy sheets throughout the inversion process which results in high reliability and minimum skew damage for a wide range of paper weights, sizes, curl conditions and image content. Further, maximum flexibility is possible on the inverted copy sheet motion and, as a consequence, the inversion time is flexible with the present invention. Also, the functioning of the present inverter is space efficient and insensitive to paper size, weight, stiffness and coefficient of friction. Still further, copy scuffing (image smearing) during the inversion process is minimized since this invention does not require velocity between the copy sheets and pressure rolls.

SUMMARY OF THE INVENTION

Accordingly, in an aspect of the present invention, a dual mode inverter is disclosed that in one mode functions as part of the normal paper path of a copier and in another mode employs reversible rolls when inversion is required. The inverter comprises tri-rolls that serve as input and output means working in conjunction with reversible rollers located downstream from the tri-rolls and adapted to either forward a sheet toward an output station or reverse the sheet back through an output means of the inverter toward a duplex tray.

BRRIEF DESCRIPTION OF THE DRAWINGS

Further features and advantages of the present invention pertaining to the particular apparatus, steps and details whereby the above mentioned aspects of the invention are attained will be included below. Accordingly, the invention will be better understood by reference to the following description and to the drawings forming a part thereof.

DESCRIPTION OF PREFERRED EMBODIMENT

Figure 1:
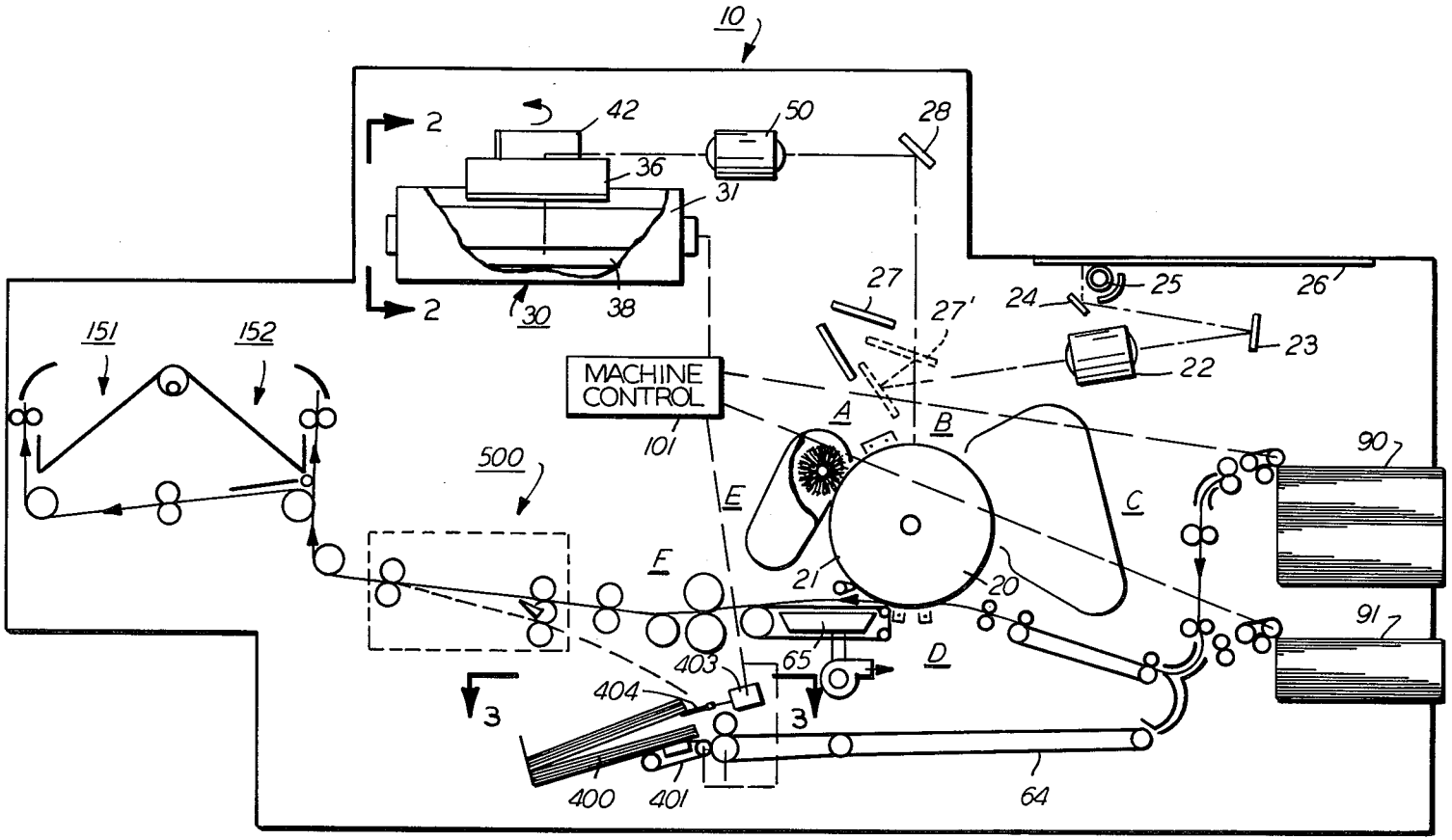
FIG. 1 is a side view of a bi-directional xerographic copying system employing the present invention.

Referring to FIG. 1, there is shown a schematic illustration of an exemplary reproduction machine 10 that employs a dual mode inverter means that will accomplish the objectives of the present invention. It includes a conventional photoconductive layer or light sensitive surface 21 on a conductive backing and formed in the shape of a drum which is mounted on a shaft journaled in a frame to rotate in the direction indicated by the arrow to cause the drum surface to pass sequentially a plurality of xerographic process stations. It should be understood that a belt photoreceptor and flash exposure could be used instead of the photoreceptor and exposure means in FIG. 1.

For purposes of the present disclosure, the several generally conventional xerographic processing stations in the path of movement of the drum surface may be described functionally as follows:

a charging station A at which the photoconductive layer of the xerographic drum is uniformly charged;

an exposure station B at which a light or radiation pattern of a document could be reproduced is projected onto the drum surface to dissipate the drum charges in the exposed areas thereof, thereby forming the latent electrostatic image of a copy to be reproduced;

a developing station C where xerographic developers are applied to the photoconductive surface of the drum to render the latent image visible;

a transfer station D at which the xerographic developer image is electrostatically transferred from the drum surface to a transfer support material;

a drum cleaning station E at which the drum surface is brushed to remove residual toner particles remaining thereon after image transfer; and a fusing station F at which point the image is fused to the copy paper or support material.

For copying, the xerographic apparatus 10 disclosed herein projects an image from the automatic web scroll document handling apparatus 30 described in U.S. Pat. No. 3,963,345, issued to D. Stemmle and M. Silverberg, which disclosure is incorporated herein by reference.

The document images are projected through lens 50 down from mirror 28 of FIG. 1 onto the photoreceptor 20. The image is developed on the photoreceptor surface 21 and rotated clockwise to a transfer station D. Copy sheets coming from either the main copy sheet feeding tray 90 or the auxiliary sheet feeding tray 91 are fed by a series of sheet feeding rollers to the transfer station D in order to accept the developed image from the photoreceptor drum 20 at the transfer station D. Vacuum stripping means 65 strips the paper from the photoreceptor 20 and transports it toward fuser F so that the image can be fused onto the copy sheet. Thereafter, the copy sheet is transported either by dual purpose inverter 500 of the present invention to duplex tray 400 or to an output sheet tray 151 or 152. For simplex copies, the duplex tray or holding means 400 is not utilized. Documents can be imaged in the apparatus of FIG. 1 either from the automatic document handler or from platen 26.

For uni-directional document copying, all of the sets will be in one output tray. The same output tray 151 is used whether the copies are simplex or duplex. Collation occurs without an inverter in the output area. For bi-directional copying, alternate sets are ultimately placed in trays 151 and 152. The forward order copies go into tray 151, and the reverse order copies go into tray 152.

Figure 2:
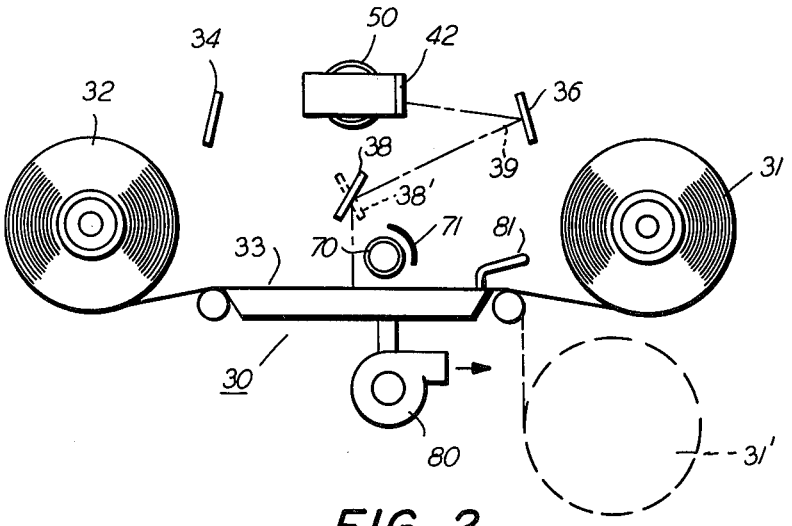
FIG. 2 is a side view taken along line 2—2 of the automatic document handling apparatus shown partly cut away in FIG. 1.

As shown in FIG. 2, documents are loaded by being placed onto web 33 against registration means 81 while scroll 31′ is in the load/unload position. As the documents are moved by the automatic document handler (hereinafter called ADH), they are exposed to light directly from exposure lamp means 70 and reflected through reflector means 71 off the document into a bi-directional optical system for projection of the document image onto photoreceptor 20. Each sheet is conveyed passed exposure means 70 and reflector means 71 and wound onto scroll means 32 after scroll means 31 has been moved into a recirculation position. Subsequently, scroll means 32 is reversed in direction toward scroll means 31 to allow re-exposure of documents wound therearound in a reverse scan mode.

For the first exposure of the documents or page images on the web, only even numbered documents are imaged, i.e., documents located in the 2, 4, 6, 8, etc. positions on web 33. Depending on whether uni-directional or bi-directional copying is desired, the buffer set is a one-set or two-set buffer, respectively. For uni-directional copying, a fast reverse rewind is accomplished and only one buffer set is required. For bi-directional copying, the even numbered documents are also imaged during reversed movement of the web to create two-buffer sets, one in ascending order (2, 4, 6 . . . ) and one in descending order (8, 6, 4, 2). In either case, copies made from exposure of the even numbered documents are fused at station F and continued in transportation on a conventional conveyor system into buffer set counter tray means 400.

Documents in the ADH are imaged, even numbered documents first on a forward pass of the ADH with the images obtained from the documents being transferred to copy sheets fed from copy sheet tray 90. After the images have been transferred at station D, the one-side imaged sheets are then forwarded toward duplex tray 400. In order to keep job integrity, it is necessary to count sheets of paper or one-sided copies as they come into the duplex tray and count the copies as they egress from the duplex tray. The number of copies in must equal the number of copies out before set separator fingers 404 will retract and allow the next set of one-sided copies to fall into the bottom of the duplex tray 400 in order to be refed for duplexing.

When a complete set or book is counted in the tray, a solenoid 403 is energized which in turn rotates a pair of fingers 404 above what is now the leading edge of the copies in the duplex tray. Sheets of the following book or set can now continue to be fed into the tray, at the same time copies of the first book are being fed out of the tray. If machine logic counts the same number of sheets of the first book fed out as were fed into the tray, the fingers 404 will retract to position 404', shown in FIG. 3, and allow the second set to drop into place for feeding by vacuum feeder means 401. If a double feed has occurred, the logic would not de-energize the solenoid because a full count had not been reached in the required time, and a machine shut-down would occur.

A programmable machine controller 101 is used to control the operation of xerographic reproduction in either the simplex or duplex modes of copier 10, such as, the controller disclosed in U.S. Pat. No. 3,940,210, which is incorporated herein by reference. The controller includes appropriate logic for counting the number of copies entering the duplex tray, counting the number of copies exiting the duplex tray, comparing the two counts, and means for actuating solenoid 403 to retract fingers 404 and allow a first set of copies to fall into feeding position while controlling actuation of the fingers for a second set of copies only when there is coincidence between ingress copies and egress copies from the duplex tray. Also, conventional counters and circuitry as disclosed in U.S. Pat. No. 3,588,472 to Thomas Glaster et al., used June 28, 1971, could be used to carry out the invention as disclosed herein and is incorporated herein by reference as could be necessary to perform the present invention.

It can be seen from FIG. 1 that duplex tray means 404, as well as vacuum feed means 401 and transport means 64, are controlled by machine control means 101 with the transport means 64 and vacuum feed means 401 being actuated in response to the completion of a set of one-sided copy sheets entering duplex tray means 400 to feed the set of copy sheets back toward transfer station D. On succeeding passes of the automatic document handler, forward and reverse, all documents are imaged with copy substrates being fed from the copy tray 90 to transfer station D alternately with copy sheets fed from feeding means 401. Copy sheets fed from primary copy sheet tray 90 receive images of even positioned documents in the ADH and are fed to buffer tray means 400 while copy sheets that are fed from feeding means 401 alternate with the sheets fed from the primary copy sheet tray 90 and receives images on the reverse side thereof of odd positioned documents in the ADH and are fed to output station 151 for copy sets made on the forward pass, or station 152 for copy sets made on the reverse pass, so that once a completed, collated set of documents have been collected in the output station, they may be stapled and side stacked or staggered, and they will still read in consecutive ascending order, for instance, 1, 2, 3, 4, 5, 6, etc. On the last pass of web 33 past the exposure station 70, only odd numbered or positioned documents are imaged. The images are then copied on the back of copies previously made from even numbered documents that are fed by feeding means 401. This process empties the feeding means 401 and presents the final set of duplexed copies to the output station. However, if a two-set buffer is used, i.e., if the ADH imaged documents on both the forward and reverse scans, odd numbered documents (only) are imaged on both of the final forward and reverse scans of web 33 in order to make complete duplexed copies of the two sets of evens adapted for feeding by means 401 in order to finish the duplex run of collated sets with an empty transport means 64 and feeding means 401.

It should be understood that odd numbered documents could be imaged on the first pass of the ADH, however, to do so would require an extra pass of the last copy sheet through the transfer station without putting an image on the even side thereof in the copying of an odd numbered document set, e.g. a set of 5 documents. Various other ways of using the machine disclosed in use with the present invention are disclosed in U.S. Pat. No. 4,116,558 by John A. Adamack and Richard T. Ziehm, which, commonly assigned with the present application disclosure, is incorporated herein by reference as it is necessary for implementation of the present invention.

In reference to FIG. 2, an optical system for scanning documents in both directions of relative reciprocal motion between the documents and the optical system is shown. The document is first scanned in one direction, then the image orientation is rotated 180° about the axis of propagation for scanning in the reverse direction. Properly oriented images are thus projected into photoreceptor 20 and move in the same direction during both directions of scan, i.e., moving in the same direction as the photoreceptor surface in both cases without reversing the photoreceptor movement. This is more fully disclosed in U.S. Pat. No. 4,008,958, issued Feb. 2, 1977 to D. O. Kingsland, commonly assigned with the present application.

Figure 3:
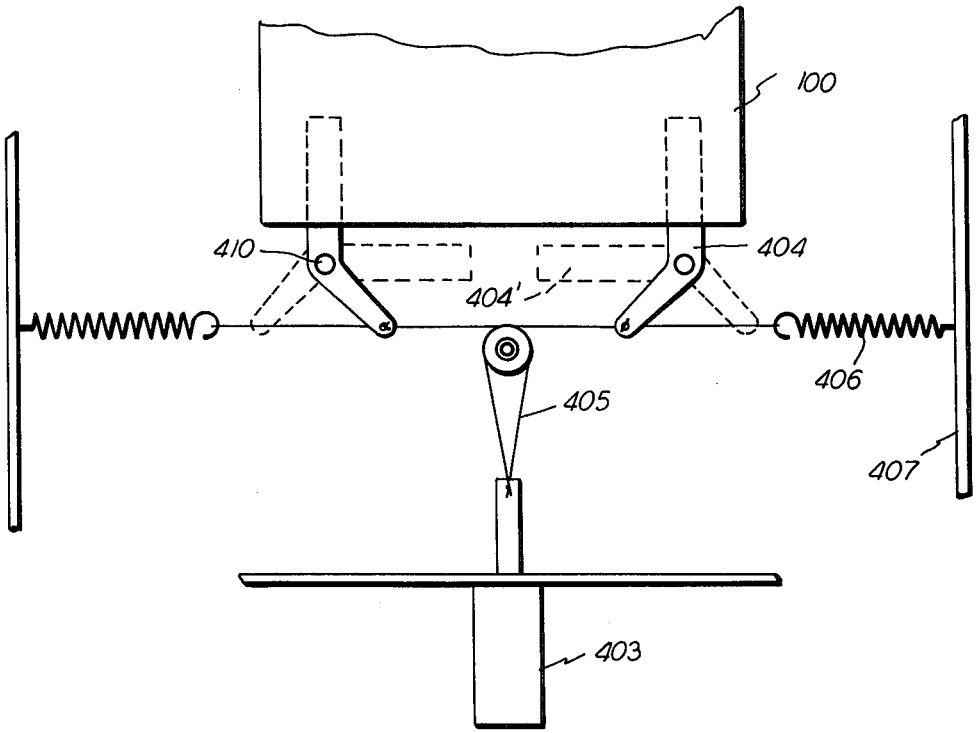
FIG. 3 is an enlarged top view taken along line 3—3 of FIG. 1.

Referring now to FIG. 3, job integrity in a duplex copying system is maintained with the use of machine controller 101 by counting the number of one-side imaged copies 100 as they come into duplex tray 400. The copies initially come to rest against set separator fingers 404 which are adapted for rotation about shaft 410 to a retracted position. When a complete set of copies is counted, solenoid 403 is actuated by controller 101 and serves to rotate cable 405, which is attached to tension springs 406. The springs are attached to stationary wall members 407. Energization of solenoid 403 rotates set separator fingers 404 through cable 405 to retracted position 404' and allows the completed set of one-sided copies to fall into feeding position adjacent vacuum feed means 401. Afterwards, the solenoid is deenergized and the fingers assume their non-retracted position.

One-side imaged copies of the next set can now continue to be fed into tray 400 and rest against set separator fingers 404 at the same time sheets are being fed from tray 400 by feeding means 401. If controller 101 counts the same number of copies of the first set fed out as was fed in, set separator fingers 404 are retracted by solenoid 403 and the second set of copies fall into position for feeding. If a misfeed occurs, machine controller 101 will not energize solenoid 403 and the fingers will not retract.

Figure 4:
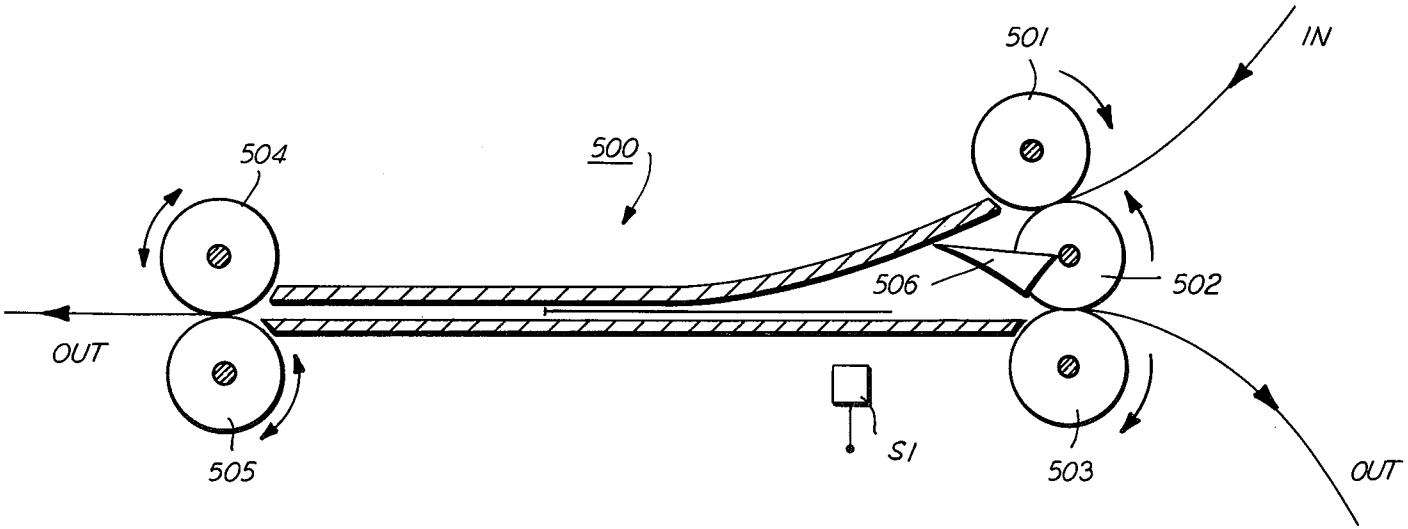
FIG. 4 is an enlarged size view of the inverter of the present invention as shown in FIG. 1.

Now referring to FIG. 4, and the present invention, dual mode inverter apparatus 500 is shown that has the capacity to act in one mode as a transportation means in the normal paper path of copier 10 and in a second mode to act as a reverser. Normal paper path is used herein to mean the route paper travels during simplex copying in a copier. The inverter comprises tri-rolls 501, 502 and 503 that serves as input and output means and reversible drive rolls 504 and 505 along with trail edge sensor 51. After a sheet leaves fuser F, it approaches an input nip formed between rolls 501 and 502 of the tri-roll inverter. If the sheet is to be transported to output means 151 or 152, reversible rolls 504 and 505 receive the sheet from the input nip and forwards it toward the output area. However, if duplex tray 400 is to be utilized, i.e., duplexing is required, the trail edge of the sheet is sensed by conventional sensor S1. This signal is transmitted to controller 101 which in turn sends a signal to a reversible drive control means that reverses the direction of rotation of rolls 504 and 505. As a result of the reversing of rolls 504 and 505, the sheet will be forwarded toward an output nip formed between rolls 502 and 503. Tri-roll gate 506 which is spring loaded insures that the new leading edge of the sheet enters into the output nip and not the input nip. The sheet is then forwarded into duplex tray 400 for subsequent processing as heretofore described.

Figure 5:
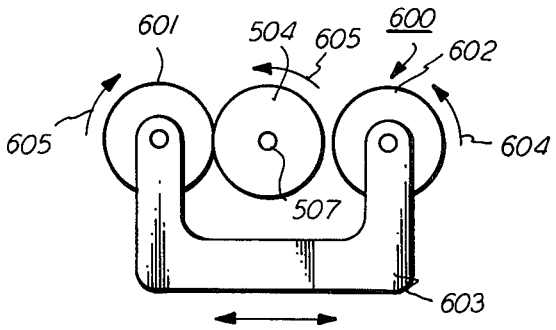
FIG. 5 is a side view of a reversible drive mechanism employed in the present invention.

While FIG. 5 shows reversible roll 504 being driven by drive mechanism 600, it should be understood that roll 505 could be used as the driven roll instead. The friction roll reversing drive roll 600 or 602 is actuated in a manner to be described by controller 101 to bring either drive roll into contact with reversible roll 504. The machine ON button causes roll mount or support 603 to shift to the right as viewed in FIG. 5 in order to place inverter 500 in a first mode whereby the inverter 500 is used as a part of the normal paper path of the sheet since rolls 504 and 505 are in the normal plane of travel of the sheet toward output means 151 or 152. In this mode, bypass of the inversion capability of the inverter is accomplished. If inversion is required, the trail edge of the sheet is sensed by sensor S1 that sends a signal to controller 101. The controller in turn actuates a conventional means, such as a screw or gear means, to move roll support 603 to the left as viewed in FIG. 5. Drive roll 602 moving in the direction of arrow 604 will then contact reversible roll 504 and drive it in a direction opposite to arrow 605 which will in turn drive the sheet back toward the output nip of the inverter formed between rolls 502 and 503. From the output nip, the sheet is forwarded to duplex tray 400.

Figure 6:
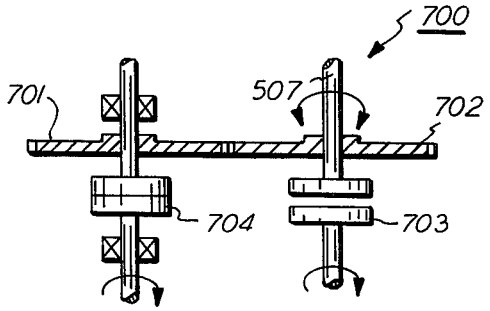
FIG. 6 is an alternative reversible drive mechanism that could be employed in the present invention.

Alternatively, a two clutch reversing roll drive means 700 could be used in the present invention. As shown in FIG. 6, gear 701 meshes with gear 702 that is connected to shaft 507 on which is mounted roll 504. Clutch 704 is shown actuated and driving gear 701 which in turn drives roll 504 counterclockwise. When inversion is required, clutch 703 is actuated while clutch 704 is deactuated. As a result, shaft 507 will be turned clockwise and roll 504 reversed and turned clockwise also since it is mounted on shaft 507.

Figure 7:
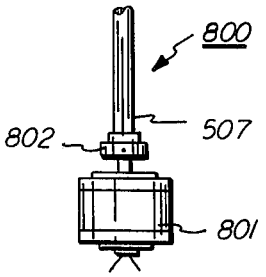
FIG. 7 is yet another alternative reversible drive mechanism that could be employed in the present invention.

In yet another embodiment of a reverse drive mechanism that could be employed in the present invention, FIG. 7 shows a reverse drive mechanism 800 that includes a reversible drive motor 801 that is connected to shaft 507 through a suitable coupling 802. With this mechanism, roll 504 ca be driven in a clockwise or counterclockwise direction as desired depending on the control signal from controller 101 and whether inversion is required.

In conclusion, a reversing roll inverter with bypass capability is disclosed that is inserted in the normal paper path of a copier and is used to either forward a sheet through the inverter for continued feeding toward an output means or reverse the sheet in a direction opposite to its initial direction of travel for further processing. The inverter allows maximum flexibility as to copy paper motion and therefore maximum flexibility of the inversion time. For example, the copy may experience three possible motions during inversion; (a) the copy paper enters and exits the inverter at process speed; (b) the copy paper enters at process speed and exits at a higher speed; or (c) the copy sheet enters at process speed, accelerates at some point to a higher speed, reverses and exits at greater than process speed. Any of the reversing roll drive mechanisms disclosed in FIGS. 5, 6 and 7 can be used with motion requirements (a) and (b) above. However, the mechanism of FIG. 7 is the only one practical for the motion requirements of concept (c) above.

In addition to the method and apparatus disclosed above, other modifications and/or additions will readily appear to those skilled in the art upon reading this disclosure and are intended to be encompassed within the invention disclosed and claimed herein.

We claim:

1. In a reproduction machine having a normal paper path of travel along which sheets are advanced, the improvement comprising:

dual mode inverting means positioned within said normal paper path and adapted to function in a first mode as an integral part of the normal paper path and serves as a transport means to transport sheets in a first direction toward an output area and function in a second mode to reverse said first direction of the sheets and forward them for further processing before they exit said inverting means in said first direction, and wherein said dual mode inverting means includes a pair of reversible rolls positioned within said normal paper path downstream from tri-roll input and output nips formed by two driven rolls positioned adjacent to and in contact with an idler roll, said reversible rolls have a uniform surface and are adapted to forward sheets in either a forward or reverse direction.

2. The reproduction machine of claim 1, wherein said dual mode inverting means includes gate means for insuring that sheets reversed by said reversible rolls enter said output nip.

3. The reproduction machine of claim 2, including reversible drive means connected to one of said reversible rolls.

4. The reproduction machine of claim 3, including sensor means positioned within said dual mode inverting means to sense the trail edge of the sheets after they have egressed from said input nip when said dual mode inverting means is in said second mode.

5. The reproduction system of claim 4, including control means adapted to receive a signal from said sensor means and actuate means for reversing the direction of rotation of said reversible rolls.

6. The reproduction machine of claim 5, wherein said means for reversing the direction of rotation of said reversible rolls comprise a U-shaped translatable support having drive rolls rotatably mounted at each end.

7. The reproduction machine of claim 5, wherein said means for reversing the direction of rotation of said reversible rolls comprises a selectively actuatable clutch.

8. The reproduction machine of claim 5, wherein said means for reversing the direction of rotation of said reversible rolls comprises a reversible drive motor.

* * * * *